US008584651B1

(12) United States Patent
Martinson et al.

(10) Patent No.: US 8,584,651 B1
(45) Date of Patent: Nov. 19, 2013

(54) ELECTRONIC IGNITION MODULE WITH REV LIMITING

(76) Inventors: Laura J. Martinson, Prior Lake, MN (US); Troy P. Martinson, Prior Lake, MN (US); John S. Titus, Prior Lake, MN (US)

( * ) Notice: Subject to any disclaimer, the term of this patent is extended or adjusted under 35 U.S.C. 154(b) by 0 days.

(21) Appl. No.: 13/490,425

(22) Filed: Jun. 6, 2012

Related U.S. Application Data

(60) Provisional application No. 61/493,978, filed on Jun. 6, 2011.

(51) Int. Cl.
*F02P 5/145* (2006.01)

(52) U.S. Cl.
USPC ..... 123/406.58; 123/618; 701/110

(58) Field of Classification Search
USPC ..... 123/406.18, 406.23, 406.24, 406.46, 123/406.5, 406.56, 406.58, 605, 618, 123/339.11; 701/110
See application file for complete search history.

(56) References Cited

U.S. PATENT DOCUMENTS

| | | | | |
|---|---|---|---|---|
| 3,601,103 | A | 8/1971 | Swiden | |
| 4,046,125 | A | 9/1977 | Mackie | |
| 4,052,967 | A | 10/1977 | Colling et al. | |
| 4,106,461 | A * | 8/1978 | Giannini | 123/613 |
| 4,393,833 | A | 7/1983 | Mann et al. | |
| 4,403,970 | A | 9/1983 | Dretzka et al. | |
| 4,538,586 | A | 9/1985 | Miller | |
| 4,558,673 | A | 12/1985 | Mackie | |
| 4,572,150 | A | 2/1986 | Foster | |
| 4,583,613 | A | 4/1986 | Nakayama | |
| 4,594,978 | A | 6/1986 | Kanno | |
| 4,606,315 | A | 8/1986 | Tobinaga et al. | |
| 4,620,521 | A | 11/1986 | Henderson et al. | |
| 4,672,941 | A | 6/1987 | Yamagata | |
| 4,697,560 | A | 10/1987 | Umehara | |
| 4,735,187 | A | 4/1988 | Kato | |
| 4,776,311 | A | 10/1988 | Venieres et al. | |
| 4,790,280 | A | 12/1988 | Umehara et al. | |

(Continued)

FOREIGN PATENT DOCUMENTS

| | | | |
|---|---|---|---|
| EP | 501746 | A1 | 9/1992 |
| EP | 618359 | A2 | 10/1994 |

(Continued)

OTHER PUBLICATIONS

"Top Ten 2012", Mopar Collectors Guide, Jan. 2013, 5 pgs.

(Continued)

*Primary Examiner* — Hai Huynh
(74) *Attorney, Agent, or Firm* — Albert W. Watkins

(57) ABSTRACT

An ignition control module for an internal combustion engine is incorporated directly into an existing ignition module package design and thereby preserves stock appearance, and is cooperative with stock magnetos, distributors and coils. The module incorporates both ignition pulse generation and adjustable rev limiting. A pushbutton switch allows manual selection of a preferred RPM to rev limit to, and the selection may be carried out under the hood while the engine is running. A plurality of light emitting diodes display the selected rev limit RPM by flashing a corresponding LED, and when not being used to select rev limit RPM, display the engine RPM in bar graph format. A digital flywheel is provided to reduce adverse affect of mechanical jitter in distributor mechanical parts, to improve timing of individual sparks. Dwell and timing curves are programmed into a microprocessor, and may be changed through external input.

19 Claims, 3 Drawing Sheets

(56) References Cited

U.S. PATENT DOCUMENTS

| | | | | |
|---|---|---|---|---|
| 4,858,585 | A | 8/1989 | Remmers | |
| 4,883,033 | A | 11/1989 | Hosoe et al. | |
| 4,895,120 | A | 1/1990 | Tobinaga et al. | |
| 4,951,624 | A | 8/1990 | Hirano | |
| 4,964,385 | A | 10/1990 | Staerzl | |
| 5,027,770 | A | 7/1991 | Yano et al. | |
| 5,058,550 | A | 10/1991 | Nagano et al. | |
| 5,070,840 | A | 12/1991 | Kanno et al. | |
| 5,085,191 | A | 2/1992 | Okuda | |
| 5,090,383 | A | 2/1992 | Demizu et al. | |
| 5,113,821 | A | 5/1992 | Fukui et al. | |
| 5,131,367 | A | 7/1992 | Aoki et al. | |
| 5,133,318 | A | 7/1992 | Yokotani et al. | |
| 5,133,319 | A | 7/1992 | Ikeda et al. | |
| 5,138,995 | A | 8/1992 | Erhard | |
| 5,138,996 | A | 8/1992 | Fiorenza, II | |
| 5,445,121 | A | 8/1995 | Kai | |
| 5,511,526 | A | 4/1996 | Hamburg et al. | |
| 5,526,785 | A | 6/1996 | Masters | |
| 5,531,206 | A | 7/1996 | Kitson et al. | |
| 6,094,615 | A * | 7/2000 | Park | 701/96 |
| 6,192,859 | B1 | 2/2001 | LeFevre | |
| 6,196,208 | B1 | 3/2001 | Masters | |
| 6,205,395 | B1 | 3/2001 | Young et al. | |
| 6,272,428 | B1 | 8/2001 | Heath et al. | |
| 6,484,692 | B2 | 11/2002 | Umemoto et al. | |
| 6,748,937 | B2 * | 6/2004 | Soza | 123/594 |
| 6,758,189 | B2 | 7/2004 | Uraki et al. | |
| 6,871,132 | B2 | 3/2005 | Olsen et al. | |
| 6,915,777 | B2 | 7/2005 | Fukushima et al. | |
| 6,938,609 | B2 | 9/2005 | Kustosch | |
| 6,964,258 | B2 | 11/2005 | Gudgeon et al. | |
| 7,040,282 | B2 | 5/2006 | Andersson et al. | |
| 7,050,899 | B2 | 5/2006 | Masters et al. | |
| 2011/0132339 | A1 * | 6/2011 | Hoffmann et al. | 123/643 |

FOREIGN PATENT DOCUMENTS

| | | | |
|---|---|---|---|
| EP | 693625 | A2 | 1/1996 |
| EP | 866222 | A2 | 9/1998 |
| EP | 1167730 | A1 | 1/2002 |
| EP | 1179672 | A1 | 2/2002 |
| EP | 1288493 | A1 | 3/2003 |

OTHER PUBLICATIONS

"Ignition Upgrade—3, 2, 1, Ignition: We find out if better ignition equals more power", Keith Dunnuck, Mopar Muscle, Nov. 2012, 3 pgs.

* cited by examiner

ELECTRONIC IGNITION MODULE WITH REV LIMITING

CROSS REFERENCE TO RELATED APPLICATIONS

This application claims the benefit of U.S. provisional patent application 61/493,978 filed Jun. 6, 2011, the entire contents which are incorporated herein by reference.

BACKGROUND OF THE INVENTION

1. Field of the Invention

The present invention relates generally to an ignition control device for an internal combustion piston engine. More particularly, an ignition module having a stock appearance and cooperative with stock magnetos, distributors and coils enables maximum torque and power of the engine while simultaneously controlling a maximum revolution rate.

2. Description of the Related Art

Many drivers of collector cars such as stock antique and classic cars desire to protect, and where possible, improve the performance of their vehicles in an unobtrusive manner, most preferably maintaining the stock appearance not only of the body of the vehicle, but also of the engine compartment as well. Of particular interest to the present disclosure is the setting of maximum engine RPM (Rotations Per Minute) limits.

Unfortunately, and for a variety of reasons, an engine may be turned too quickly. For exemplary purposes only, and not limiting the present disclosure thereto, slip during acceleration, a slipping or blown clutch, a missed gear, failure to engage the clutch before fully opening the throttle, component failure such as a transmission failure, carelessness, and other such factors can lead to excessive engine RPMs. This can lead to engine failure, and may even result in an explosion or flying debris that can endanger bystanders. The aforementioned and other events that can lead to excessive RPMs can be further compounded by already high RPMs such as frequently occur during a race or upon traversing inconsistent or unpredictable surfaces such as ice or snow-packed roadways.

Typical stock ignition systems deliver electrical charge to engine spark plugs at energy levels well below component tolerances. Such stock ignition systems also do not usually provide over-rev protection. As a result, the operation and performance of the engine is compromised.

Recognizing a need for improved ignition systems, early pioneers developed a variety of electronic ignition systems that could provide improved control over the ignition spark. Exemplary of these are U.S. Pat. Nos. 4,052,967 by Colling et al, entitled "Digital electronic ignition spark timing system" and 4,790,280 by Umehara et al, entitled "Ignition apparatus", the contents and teachings of each which are incorporated herein in entirety.

One popular approach to an electronic ignition is the capacitive discharge ignition (CDI) system. Exemplary are U.S. Pat. Nos. 4,046,125 by Mackie, entitled "Capacitive discharge ignition system"; 4,538,586 by Miller, entitled "Capacitive discharge ignition with long spark duration"; 4,620,521 by Henderson et al, entitled "Modular, programmable high energy ignition system"; 5,526,785 by Masters, entitled "Electronic ignition system"; 5,531,206 by Kitson et al, entitled "Capacitative discharge ignition system for internal combustion engines"; and 6,196,208 by Masters, entitled "Digital ignition", the contents and teachings of each which are incorporated herein in entirety. One feature of these CDI systems is the ability to store energy in the capacitor and release that energy at desired times, assisting with the generation of an intense spark within the combustion chamber.

An additional development in electronic ignition systems is the incorporation of a computing device to programmably control spark. For the purposes of the present disclosure, the terms microprocessor, microcontroller, computer, computing device, CPU, and any other terms for electronic devices that permit software or programmed control over the system will be understood to be equivalent. Exemplary patents that illustrate computing devices within an ignition system, the contents and teachings of each which will be understood to be incorporated herein by reference in entirety, include: U.S. Pat. No. 4,558,673 by Mackie, entitled "Electronic ignition system for internal combustion engines"; U.S. Pat. No. 4,776,311 by Venieres et al, entitled "Process and device for limiting the running speed of an internal combustion engine with electronic ignition"; U.S. Pat. No. 4,883,033 by Hosoe et al, entitled "Ignition timing control system for internal combustion engines"; U.S. Pat. No. 4,895,120 by Tobinaga et al, entitled "Ignition control system for an internal combustion engine"; U.S. Pat. No. 5,131,367 by Aoki et al, entitled "Method for controlling ignition timing of internal combustion engine and apparatus therefor"; U.S. Pat. No. 5,138,995 by Erhard, entitled "Ignition process, arrangement and apparatus for internal combustion engines with a magneto"; 5,445,121 by Kai, entitled "Engine operational control unit"; U.S. Pat. No. 6,205,395 by Young et al, entitled "Ignition system and method of programming an ignition system"; U.S. Pat. No. 6,272,428 by Heath et al, entitled "Method and system for engine ignition for timing controlled on a per cylinder basis"; U.S. Pat. No. 6,484,692 by Umemoto et al, entitled "Ignition control system"; U.S. Pat. No. 6,915,777 by Fukushima et al, entitled "Control system for general-purpose engine"; and U.S. Pat. No. 7,040,282 by Andersson et al, entitled "Independent timing retard for engine speed limiting".

Recognizing the particular importance of rev limiting, some inventors have designed rev limiting circuitry that will operate in association with an ignition system, for exemplary purposes to disable selected sparks, thereby selectively preventing combustion from occurring within one or more cylinders during a crankshaft revolution. Exemplary patents, the contents and teachings of each which will be understood to be incorporated herein by reference in entirety, include: U.S. Pat. No. 4,594,978 by Kanno, entitled "Over-revolution preventing apparatus for internal combustion engines"; U.S. Pat. No. 6,192,859 by LeFevre, entitled "Low cost, temperature stable, analog circuit RPM limiter"; U.S. Pat. No. 6,964,258 by Gudgeon et al, entitled "Engine revolution limiter"; and U.S. Pat. No. 7,050,899 by Masters et al, entitled "Slew rate revlimiter".

Additional patents and published applications, the contents and teachings of each which will be understood to be incorporated herein in entirety, include: U.S. Pat. No. 3,601,103 by Swiden, entitled "Engine-condition-responsive cutoff apparatus"; U.S. Pat. No. 4,393,833 by Mann et al, entitled "Device for the control of the traveling speed of a motor vehicle"; U.S. Pat. No. 4,403,970 by Dretzka et al, entitled "Marine propulsion unit having ignition interruption means to assist transmission shifting"; U.S. Pat. No. 4,572,150 by Foster, entitled "Engine including means for retarding sparking operation to control engine overspeed"; U.S. Pat. No. 4,583,613 by Nakayama, entitled "Three wheel motorcycle with reverse mechanism"; U.S. Pat. No. 4,606,315 by Tobinaga et al, entitled "Ignition control system for an internal combustion engine"; U.S. Pat. No. 4,672,941 by Yamagata, entitled "Ignition system"; U.S. Pat. No. 4,697,560 by Umehara, entitled "Rotating speed control apparatus for an internal combustion engine"; U.S. Pat. No. 4,735,187 by Kato, entitled "Ignition system for internal combustion engines"; U.S. Pat. No. 4,858,585 by Remmers, entitled "Electronically assisted engine starting means"; U.S. Pat. No. 4,951,624 by Hirano, entitled "Ignition control for an engine to prevent overheating and backfiring"; U.S. Pat. No. 4,964,385 by Staerzl, entitled "Engine overspeed control"; U.S. Pat. No. 5,027,770 by Yano et al, entitled "Ignition controller"; U.S. Pat. No. 5,058,550 by Nagano et al, entitled "Method for determining the control values of a multicylinder internal combustion engine and apparatus therefor"; U.S. Pat. No. 5,070,840 by Kanno et al, entitled "Ignition system for marine propulsion unit"; U.S. Pat. No. 5,085,191 by Okuda, entitled "Tachometer signal generating device"; U.S. Pat. No. 5,090,383 by Demizu et al, entitled "Ignition timing control apparatus for an internal combustion engine"; U.S. Pat. No. 5,113,821 by Fukui et al, entitled "Vehicle speed governor"; U.S. Pat. No. 5,133,318 by Yokotani et al, entitled "Afterburning preventive ignition apparatus for an internal combustion engine"; U.S. Pat. No. 5,133,319 by Ikeda et al, entitled "Engine speed control apparatus"; U.S. Pat. No. 5,138,996 by Fiorenza, entitled "Microprocessor-based engine speed limiter"; U.S. Pat. No. 5,511,526 by Hamburg et al, entitled "Engine air/fuel control with adaptive learning"; U.S. Pat. No. 6,758,189 by Uraki et al, entitled "Engine revolution control apparatus having overspeed governing capability"; U.S. Pat. No. 6,871,132 by Olsen et al, entitled "Engine limiter for powered vehicles"; U.S. Pat. No. 6,938,609 by Kustosch, entitled "Method and device for controlling the drive unit of a motor vehicle"; EP0501746 by Nagano et al, entitled "Altitude determination system and engine control system using the same."; EP0618359 by Werner, entitled "Ignition system with device to limit revolutions and stabilise idling for a combustion engine."; EP0693625 by Mizuno et al, entitled "An ignition timing control device for an engine"; EP0866222 by Inagaki, entitled "Ignition timing control system for industrial engines"; EP1167730 by Kanamaru et al, entitled "Device for controlling rotational speed of internal combustion engine"; EP1179672 by Ogawa et al, entitled "Control system and method for internal combustion engine."; and EP1288493 by Ohno et al, entitled "Ignition timing control system and method, and engine control unit for internal combustion engine".

In addition to the foregoing, Webster's New Universal Unabridged Dictionary, Second Edition copyright 1983, is incorporated herein by reference in entirety for the definitions of words and terms used herein.

In spite of the substantial development that has occurred in this field, there remains a need for a device that minimizes the likelihood of over-revving of an engine and which is most preferably incorporated directly into an existing ignition module package outline. This is particularly true in the case of collector cars, such as stock antique and classic cars, where cars are commonly judged not just on performance, but also on the maintenance of original or stock appearance.

SUMMARY OF THE INVENTION

In a first manifestation, the invention is, in combination, an internal combustion engine and an ignition module. The engine has at least one combustion cylinder generally closed at one end. At least one piston operatively reciprocates within the combustion cylinder and thereby defines at least one combustion chamber between the combustion cylinder closed end and the piston. The piston is coupled with and at least partially drives rotation of a crank shaft. At least one input and at least one exhaust permit the flow of combustible mixture into the combustion chamber and the flow of gases from the combustion chamber. At least one spark plug protrudes into the combustion chamber and operatively provides an ignition spark to ignite combustible mixture therein. A timing apparatus effectively detects a position of the piston within the combustion cylinder and generates a timing signal responsive thereto. The ignition module has a housing and an electronic ignition circuit responsive to the timing signal for initiating ignition spark. The improvement comprises the ignition module housing having an external stock appearance, and the ignition module electronic ignition circuit having a crankshaft rotation rate monitor and a rev limiter for limiting crankshaft rotation rate when the monitor determines that a first predetermined rotation rate has been exceeded, wherein the rev limiter includes a plurality of predetermined available rotation rates.

In a second manifestation, the invention is a method of limiting maximum engine speed. According to the method, an ignition control module having a stock appearance is provided. Engine speed is monitored. A predetermined maximum speed threshold is manually selected from a plurality of possible thresholds. When engine speed is detected as exceeding the predetermined maximum speed threshold, engine speed is limited through control by the ignition control module.

OBJECTS OF THE INVENTION

Exemplary embodiments of the present invention solve inadequacies of the prior art by providing an ignition control device for an internal combustion engine that is incorporated directly into an existing ignition module package design and thereby preserves stock appearance, and that is cooperative with stock magnetos, distributors and coils. The ignition control device enables maximum torque and power of the engine while simultaneously controlling a maximum revolution rate.

A first object of the invention is to provide a plug-in replacement for stock ignition modules that is contained within a housing that is visually matched to the stock ignition module. An ancillary object is to provide a visually matched replacement for a Chrysler™ ignition module. A second object of the invention is to provide adjustable rev limiting. Another object of the present invention is to enable adjustment of the rev limiting rate while the engine is running. A further object of the invention is to provide adjustment of the rev limit set point through multiple set points by multiple actuations of a single pushbutton switch. Yet another object of the present invention is to display the rev limit set point directly on the ignition module by flashing one of a set of numbered indicating lights. An additional object of the invention is to operatively display engine speed on the set of numbered indicating lights as a bar graph. A further object of the invention is to smooth mechanical ignition drive train jitter by averaging the input provided to the ignition module, thereby creating a digital flywheel. Another object of the invention is the provision of programmed dwell and timing curves. Yet another object of the invention is to allow programming changes through an input connector.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
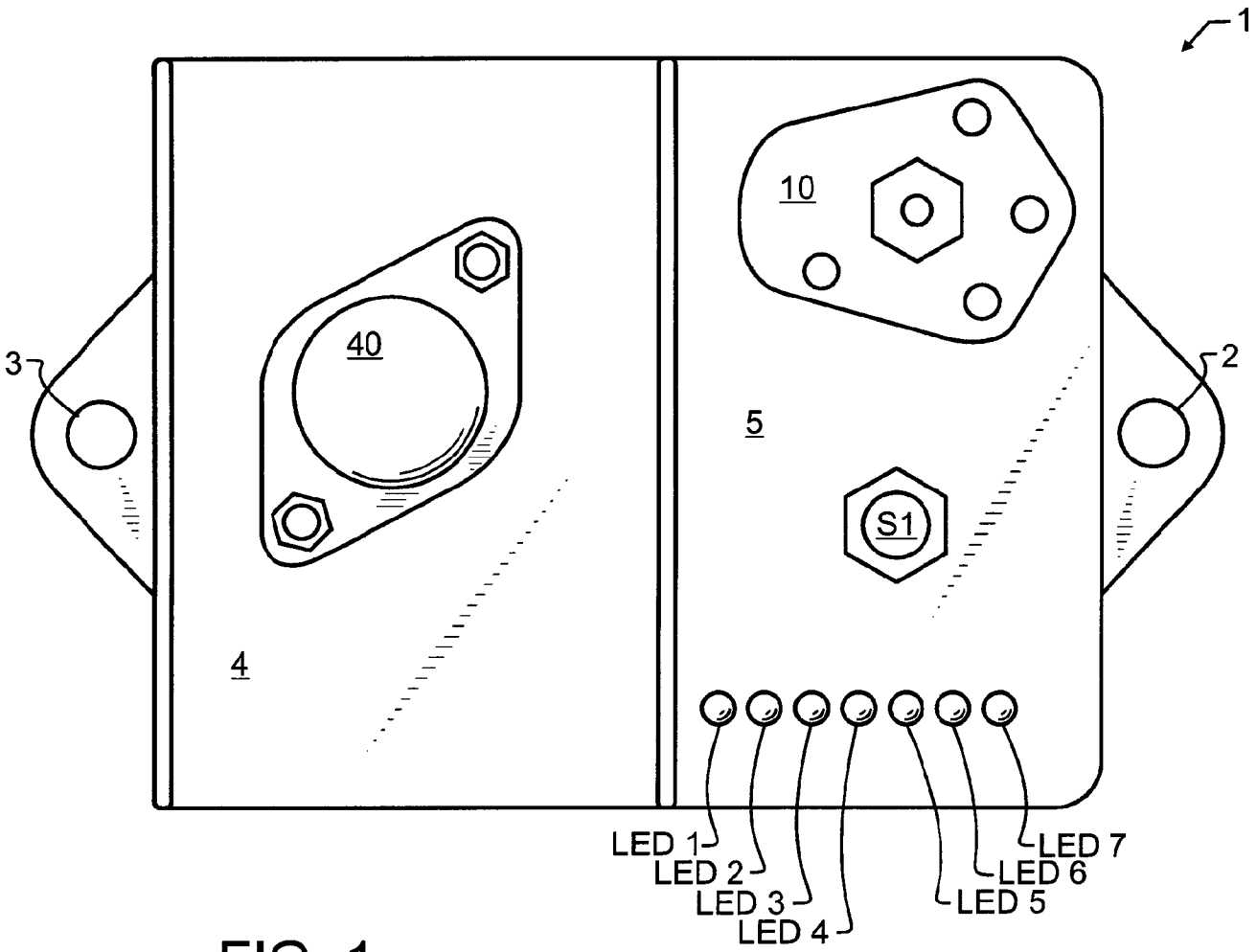
FIG. 1 illustrates a preferred embodiment electronic ignition module with rev limiting designed in accord with the teachings of the present invention from a top view.

In a preferred embodiment of the invention illustrated in FIG. 1, a electronic ignition module 1 with rev limiting is comprised of a housing 5 having mounting tabs 2, 3 that provide electrical grounding connection, a TO-3 housed voltage regulator 40 identical in appearance to standard TO-3 housings for stock power transistors mounted externally upon a heat sink 4, and one or more electrical connectors such as ignition connector 10. These features are preferably designed to visually correspond with or preferably identically match stock parts. The model illustrated is a replacement for Chrysler™ or Mopar™ ignition modules, and the components aforementioned are identical to a stock ignition module, though the module in accord with the present teachings may be designed to correspond to or match other makes and parts designs. A bank of Light-Emitting Diodes LED1-LED7 are most preferably provided as visual indicators of the status of the module. Other suitable indicators may be provided, or there may be applications where no indications whatsoever would be provided, and in such cases the present invention may externally exactly match the external stock components.

In the illustrated preferred embodiment, the bank of seven LEDs designate seven different RPM limits. Preferably, the RPM limit is preferably easily changed by the touch of a pushbutton switch S1 that may be provided either on the ignition module as illustrated or provided externally and coupled to module 1 through a control wire input. The LED associated with the RPM limit selected will then illuminate. For exemplary purposes, the following table shows the particular LED that is lit, and under the LED number, the RPM limit associated therewith for the preferred embodiment:

| 1 | 2 | 3 | 4 | 5 | 6 | 7 |
|---|---|---|---|---|---|---|
| 3,000 | 5,000 | 5,500 | 6,000 | 6,500 | 7,000 | 7,500 |

The rev limiter monitors the revolutions per minute of a crankshaft of an engine and slows the engine when the rotational speed of the crankshaft exceeds a predetermined value. In this manner, the rev limiter serves to prevent engine overrevving. The particular technique used to slow the engine is not critical to the present invention, and so may encompass any known techniques including but not limited to those in the patents incorporated by reference herein above, which, for exemplary purposes could include such techniques as total spark inhibition, selective spark inhibition, and spark delay or retardation.

Figure 2:
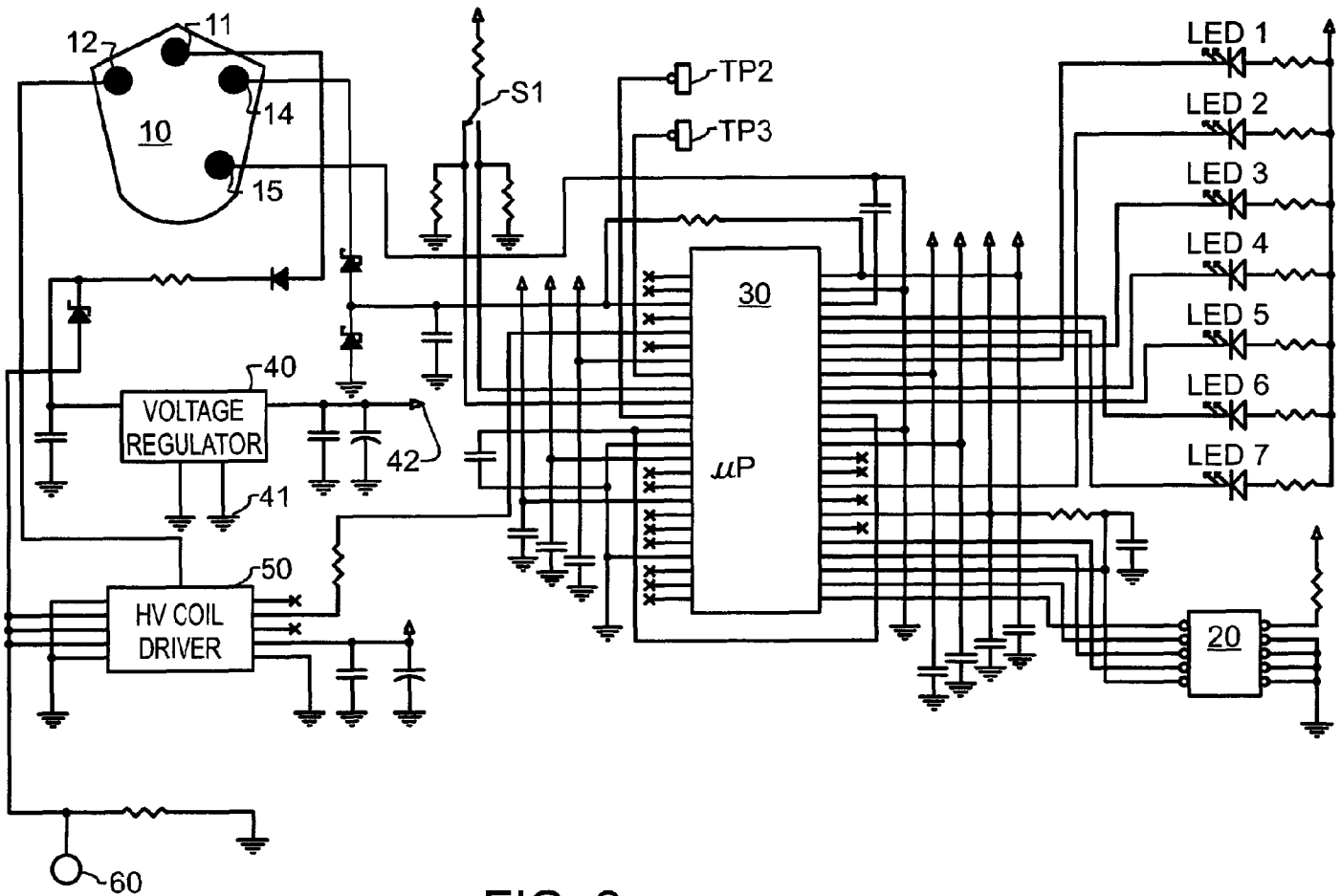
FIG. 2 schematically illustrates a preferred embodiment electronic ignition control circuit that is preferably incorporated within the preferred embodiment electronic ignition module of FIG. 1.

There are a variety of electronic ignition control circuits that are contemplated herein for incorporation within the package illustrated in FIG. 1, including but not limited to those illustrated in the United States patents incorporated by reference herein above. Nevertheless, a preferred embodiment electronic ignition control circuit is illustrated schematically in FIG. 2.

The stock Chrysler™ ignition module connector 10 has electrical connector terminal 11 which provides standard automotive power, typically of approximately 12-15 volts, from the vehicle electrical system. The power source is typically controlled by the vehicle ignition key switch used to start and run the vehicle. The power input, which as indicated may be quite variable, is regulated very precisely by voltage regulator 40 to provide a fixed positive output voltage at common power supply bus 42 with reference to a ground bus. The open arrow head shown in the schematic is, as is standard, coupled to all other similarly illustrated open arrow heads. Likewise, the ground bus 41 is coupled to all like illustrated ground connections. A separate ground connection 60 may be provided which is directly connected to vehicle ground, such as through mounting tabs 2,3. In this case, a low resistance high power resistor may be provided between ground connection 60 and ground bus 41, if so desired.

Many modern voltage regulators provide a combination of precise voltage output and additional other protective features such as thermal shutdown and overcurrent limiting. Consequently, voltage regulator 40 may be used not only for precise voltage regulation but also for safety features. A fuse may also optionally be provided, but where voltage regulator 40 provides these safety features, the fuse is not only unnecessary, but also less reliable. In many cases, more generic fuses are also provided within the vehicle fuse panel.

Electrical connector terminals 14, 15 provide the inputs from a two-wire inductive proximity sensor or equivalent located within the distributor, as is known in the art and standard on Chrysler ignition modules. These inputs are received by microprocessor 30 and used to calculate proper ignition timing.

Pushbutton switch S1, as aforementioned, is used to provide selective pulses to microprocessor 30. These selective pulses are then used by microprocessor 30 to select and set the rev limiting RPM rates as described herein above. Most preferably, in response to a person actuating switch S1, microprocessor 30 will signal the new rev limiting RPM rate by flashing the appropriate one of LED1-LED7. While seven LEDs are illustrated in the preferred embodiment, more or fewer LEDs may be used without departing from the spirit of the present invention.

The flashing will, in the preferred embodiment, be for a brief but not indefinite period, so that a person can receive positive affirmation that the desired setting has taken effect. If the new rate is not the one desired, the person will simply press switch S1 again, thereby stepping through the available rev limiting RPM rates.

Pushbutton switch S1 is preferably designed to be active when the engine is running, which means that the rate can also be changed while the engine is running. This is in stark contrast to the prior art, which relies upon programmed settings that must be made while the engine is not running. Further, the systems that rely on program changes also require special readers to indicate what the chosen limit is, whereas the present invention simply requires the pressing of pushbutton switch S1.

In addition to indicating a selected rev limiting RPM rate, LED1-LED7 will also preferably operatively display current engine using LED1-LED7 to visually provide a bar graph. For exemplary purposes only, and not limited solely thereto, LED1 may illuminate when the crankshaft is rotating at 1,000 RPM. Below 1,000 RPM, none of the LEDs will be illuminated. At 2,000 RPM, both LED1 and LED2 will be illuminated. With each additional 1,000 RPM increment, another LED will be illuminated, making it very simple for a person to visually determine what the present crankshaft RPM is, within the limit of resolution determined by the number of LEDs provided. Consequently, while for some applications only a few settings may be required for rev limiting, and therefore only requiring a few LEDs, having seven LEDs facilitates indication of RPM in 1,000 RPM increments up to 7,000 RPMs, which is adequate for many engines.

To enable programming of microprocessor 30, either at the factory or in the field as may be desired or necessitated, an electrical connector 20 may be provided. A separate programming apparatus such as is known in the art of microprocessors may then be connected to selectively switch the programming input connections from microprocessor 30 to either ground bus 41 or positive bus 42 as may be appropriate. Both dwell and timing curves may then be set through programming, and may then be varied to suit the characteristics of an engine or desired by an operator.

High voltage coil driver 50 is a commercially available component which receives an input trigger from microprocessor 30 and, responsive thereto, produces an output to electrical connector terminal 12 which is electrically connected to the ignition coil. Consequently, when microprocessor 30 provides a pulse, high-voltage coil driver 50 converts the low-current signal pulse from the microprocessor into a very high current pulse sufficient to produce a desirably energetic spark.

While a commercially available off-the-shelf high-voltage coil driver 50 is preferred for simplicity, size and reliability, discrete components may alternatively be used to implement the function of high-voltage coil driver 50 using known circuit layouts such as those used for commercial implementations or such as illustrated in the patents incorporated herein above by reference, if so desired.

Test points TP2, TP3 may optionally be provided, and if so together with ground connection 60 serve to provide limited access for diagnostic testing.

As described herein above, ignition timing is determined by electrical signals delivered to electrical connector terminals 14, 15. These signals are typically derived from a proximity sensor or equivalent located within the distributor. The mechanical apparatus that signals this ignition timing is subject to wear and tolerance degradation over time, and develops increasing amounts of jitter and variability, which reduces the precision available for spark timing and in turn reduces the efficiency, power and torque available. The preferred embodiment smooths this mechanical ignition drive train jitter by averaging the input pulses provided to the ignition module. Consequently, variances between proper timing pulses and sensed timing pulses that arise due to mechanical jitter, wobble or the like are removed. The preferred embodiment then, through this averaging of the timing intervals, thereby creates a digital flywheel that is insensitive to short duration mechanical jitter.

The present invention also preferably does not incorporate the popular capacitor discharge found in many electronic ignition systems. While not being bound to any particular theory, particularly at higher RPMs, the reactance of the various components is believed by the present inventors to reduce the efficacy of CDI systems. The present invention overcomes that limitation.

Figure 3:
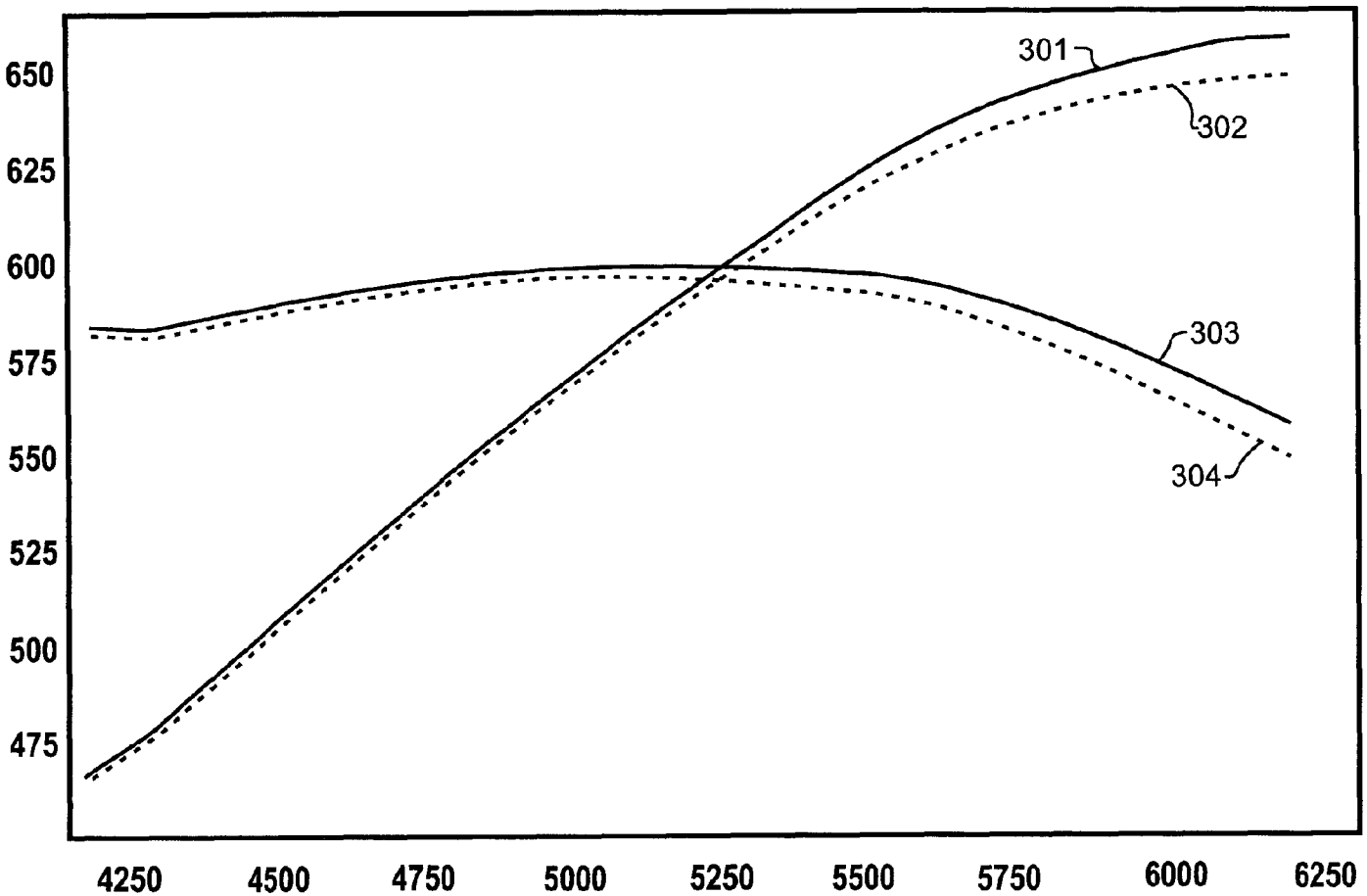
FIG. 3 illustrates a graph comparing torque and power output of the present invention with a popular commercial replacement ignition module.

FIG. 3 illustrates independent dyno-testing performance of the present invention relative to a very popular prior art electronic ignition module currently produced and sold by MSD™ that incorporates a CDI system. Line 301 illustrates the power output in horsepower from the engine equipped with the preferred embodiment, while line 302 illustrates the power output from the same engine equipped with the prior art module. As illustrated, as the RPMs increase, the present invention more significantly exceeds that of the prior art module. Likewise, line 303 illustrates the torque in foot-pounds from then engine equipped with the preferred embodiment, while line 304 illustrates the engine equipped with the prior art module. Again, as the RPMs increase the variance between the present invention and the prior art increases. Similar testing from a different independent test lab produced similar results when tested on engines without ignition coil ballast. The present invention averaging 516 foot-pounds of torque through a range of 3,000-6,000 RPM measured in 100 RPM increments, and the prior art module averaging only 497.5 foot-pounds of torque. The present invention exceeded the torque of the prior art at all RPMs tested. Likewise, the power output of the present invention averaged 444.4 horsepower, while the prior art averaged only 427.3 horsepower, and again the present invention exceeded the prior art at all RPMs tested.

There are many benefits that are derived from the present invention. A stock appearance ignition control module having a built-in rev limiter with, in the preferred embodiment, seven different RPM limits, allows an owner to select the best RPM to protect a given engine from over-revving. At the same time, for the purist stock classic car owner, the present invention provides a the perfect bolt-in replacement part, without requiring a separate over-rev limiter, to ensure both visual and physical compatibility with stock parts, while offering the rev limiting features. Since all features are integrated into the stock box, there is no need for extra wires or boxes, and the invention directly bolts into stock locations and uses the original wiring. In addition, the 3,000 RPM setting, which serves as a test setting and which may be selected at any time by the owner simply by opening the hood and pressing pushbutton switch S1, is perfect protection if a thief takes the car, or if a family member or service person decides to take the car for a joy ride. With the preferred electronic ignition module with rev limiting installed, a missed shift, slip or other event that might otherwise damage the engine will be prevented. The heart of the beast, the engine, will be safe.

From the foregoing figures and description, several additional features and options become more apparent. First of all, an electronic ignition module with rev limiting as taught and illustrated herein may be manufactured from a variety of materials, including metals, resins and plastics, ceramics or cementitious materials, or even combinations or composites of the above. The specific material used may vary, though special benefits are attainable if several important factors are taken into consideration. First, a preferred electronic ignition module will preferably be designed to fit within the same footprint and appear to be an original stock component. Second, the materials used must withstand the voltage potentials, temperatures and other environmental factors likely to be encountered during operation within a hot engine compartment.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. In combination, an internal combustion engine having:

at least one combustion cylinder generally closed at one end;

at least one piston operatively reciprocating within said at least one combustion cylinder and thereby defining at least one combustion chamber between said at least one combustion cylinder closed end and said at least one piston, said piston coupled with and at least partially driving rotation of a crank shaft;

at least one input and at least one exhaust permitting the flow of combustible mixture into said at least one combustion chamber and the flow of gases from said at least one combustion chamber;

at least one spark plug protruding into said at least one combustion chamber and operatively providing an ignition spark to ignite said combustible mixture therein;

a timing apparatus for effectively detecting a position of said at least one piston within said at least one combustion cylinder and generating a timing signal responsive thereto; and an ignition module having a housing and an electronic ignition circuit responsive to said timing signal for initiating said ignition spark;

wherein the improvement comprises said ignition module housing having an external stock appearance, and said ignition module electronic ignition circuit having a crankshaft rotation rate monitor and having a rev limiter for limiting crankshaft rotation rate when said monitor determines that a first predetermined rotation rate has been exceeded, wherein said rev limiter includes a plurality of predetermined rotation rates, and wherein said ignition module further comprises a plurality of indicator lights indicative in a first mode of said first predetermined rotation rate, and in a second mode of said crankshaft rotation rate.

2. The combination internal combustion engine and ignition module of claim 1, wherein said rev limiter further comprises a manually actuated switch, the manual actuation which sets which of said plurality of predetermined rotation rates is used by said rev limiter to limit said crankshaft rotation rate.

3. The combination internal combustion engine and ignition module of claim 2, wherein said manually actuated switch further comprises a pushbutton switch, and repetitive actuations of said pushbutton switch step through individual ones of said plurality of predetermined rotation rates.

4. The combination internal combustion engine and ignition module of claim 1, wherein said plurality of indicator lights flash a selected one of said plurality of indicator lights to indicate said first predetermined rotation rate and provide a bar graph indicative of said crankshaft rotation rate.

5. The combination internal combustion engine and ignition module of claim 1, wherein said ignition module further comprises an averaging apparatus receiving said timing signal and averaging the interval between said timing signals, and using said averaged interval to initiate said ignition spark.

6. The combination internal combustion engine and ignition module of claim 1, wherein said ignition module further comprises a programmable microprocessor, and a program determining at least one of dwell and timing curves.

7. The combination internal combustion engine and ignition module of claim 6, wherein said ignition module further comprises an input connector operatively coupled to said programmable microprocessor enabling reprogramming of said at least one of dwell and timing curves.

8. A method of limiting maximum engine speed, comprising the steps of:

providing an ignition control module having a stock appearance;

monitoring engine speed;

averaging said monitoring of said engine speed over time;

triggering an ignition spark responsive to said averaged engine speed, to thereby reduce adverse effects of mechanical jitter;

manually selecting a predetermined maximum speed threshold from a plurality of possible thresholds within said ignition control module;

detecting when engine speed exceeds said predetermined maximum speed threshold; and limiting engine speed through control by said ignition control module while said predetermined maximum speed threshold is exceeded.

9. The method of limiting maximum engine speed of claim 8, wherein said step of manually selecting a predetermined maximum speed threshold from a plurality of possible thresholds further comprises manually selecting while said engine speed is greater than zero.

10. The method of limiting maximum engine speed of claim 8, wherein said step of manually selecting a predetermined maximum speed threshold from a plurality of possible thresholds further comprises the step of repetitively pressing a switch to step through and select individual ones of said plurality of possible thresholds until a desired one of said plurality of possible thresholds is selected.

11. The method of limiting maximum engine speed of claim 8, further comprising the step of indicating said selected predetermined maximum speed threshold by flashing a light.

12. The method of limiting maximum engine speed of claim 11, wherein said indicating step further comprises flashing a selected one of a plurality of lights, said selected one corresponding to said selected predetermined maximum speed threshold.

13. The method of limiting maximum engine speed of claim 8, further comprising the step of displaying said engine speed by illuminating a representative number of lights simultaneously.

14. The method of limiting maximum engine speed of claim 8, further comprising the steps of: programming a timing curve; and storing said programmed timing curve in said ignition control module.

15. The method of limiting maximum engine speed of claim 8, further comprising the steps of: programming a dwell curve; and storing said programmed dwell curve in said ignition control module.

16. In combination, an internal combustion engine having:

at least one combustion cylinder generally closed at one end;

at least one piston operatively reciprocating within said at least one combustion cylinder and thereby defining at least one combustion chamber between said at least one combustion cylinder closed end and said at least one piston, said piston coupled with and at least partially driving rotation of a crank shaft;

at least one input and at least one exhaust permitting the flow of combustible mixture into said at least one combustion chamber and the flow of gases from said at least one combustion chamber;

at least one spark plug protruding into said at least one combustion chamber and operatively providing an ignition spark to ignite said combustible mixture therein;

a timing apparatus for effectively detecting a position of said at least one piston within said at least one combustion cylinder and generating a timing signal responsive thereto; and an ignition module having a housing and an electronic ignition circuit responsive to said timing signal for initiating said ignition spark;

wherein the improvement comprises said ignition module electronic ignition circuit having a crankshaft rotation rate monitor and having a rev limiter for limiting crankshaft rotation rate when said monitor determines that a first predetermined rotation rate has been exceeded, wherein said rev limiter includes a plurality of predetermined rotation limit rates, said ignition module housing having a plurality of indicator lights on a visible exterior thereof that are indicative in a first mode of one of said first predetermined rotation limit rates that said rev limiter is set to limit crankshaft rotation to, and indicative in a second mode of said crankshaft rotation rate.

17. The combination internal combustion engine and ignition module of claim 16, wherein said plurality of indicator lights in said first mode flash a selected one of said plurality of indicator lights to indicate said one of said first predetermined rotation limit rates and in said second mode provide a bar graph indicative of said crankshaft rotation rate.

18. The combination internal combustion engine and ignition module of claim 16, wherein said ignition module further comprises an averaging apparatus receiving said timing signal and averaging the interval between said timing signals, and said ignition module further operatively uses said averaged interval to initiate said ignition spark and thereby reduce adverse effects of mechanical jitter.

19. In combination, an internal combustion engine having:

at least one combustion cylinder generally closed at one end;

at least one piston operatively reciprocating within said at least one combustion cylinder and thereby defining at least one combustion chamber between said at least one combustion cylinder closed end and said at least one piston, said piston coupled with and at least partially driving rotation of a crank shaft;

at least one input and at least one exhaust permitting the flow of combustible mixture into said at least one combustion chamber and the flow of gases from said at least one combustion chamber;

at least one spark plug protruding into said at least one combustion chamber and operatively providing an ignition spark to ignite said combustible mixture therein;

a timing apparatus for effectively detecting a position of said at least one piston within said at least one combustion cylinder and generating a timing signal responsive thereto; and an ignition module having a housing and an electronic ignition circuit responsive to said timing signal for initiating said ignition spark;

wherein the improvement comprises said ignition module housing having an external stock appearance, and said ignition module electronic ignition circuit having a crankshaft rotation rate monitor and having a rev limiter for limiting crankshaft rotation rate when said monitor determines that a first predetermined rotation rate has been exceeded, wherein said rev limiter includes a plurality of predetermined rotation rates, and wherein said ignition module further comprises an averaging apparatus receiving said timing signal and averaging the interval between said timing signals, and using said averaged interval to initiate said ignition spark.

* * * * *